US005884132A

United States Patent [19]

Gotham et al.

[11] Patent Number: 5,884,132

[45] Date of Patent: Mar. 16, 1999

[54] CABINETRY WITH SHAPE-BASED INDICATORS

[75] Inventors: David R. Gotham; Kevin C. Koek, both of Rochester; Timothy J. White, Webster; Robert Gerenski, Holley, all of N.Y.

[73] Assignee: Eastman Kodak Company, Rochester, N.Y.

[21] Appl. No.: 954,548

[22] Filed: Oct. 20, 1997

[51] Int. Cl.[6] ..... G03G 15/00

[52] U.S. Cl. ..... 399/393; 271/145; 399/391

[58] Field of Search ..... 399/405, 391, 399/393; 355/75; 271/145, 9.01

[56] References Cited

U.S. PATENT DOCUMENTS 5,313,257 5/1994 Kashima et al. ..... 399/393

5,676,370 10/1997 Taniguchi et al. ..... 271/145 X 5,758,249 5/1998 Dutton et al. ..... 399/391

*Primary Examiner*—S. Lee

*Attorney, Agent, or Firm*—Lawrence P. Kessler

[57] ABSTRACT

A copier has a plurality of paper trays for holding paper, and a housing having a front surface as cabinetry with shape-based indicators. The front surface includes a plurality of access panels adjacent to the paper trays, with each access panel allowing access to a respective paper tray, and each access panel has a curved exposed surface extending from the front surface. Each access panel includes a flat exposed surface extending from the respective access panel and having output indicators for indicating status conditions of a set of copying components.

15 Claims, 4 Drawing Sheets

CABINETRY WITH SHAPE-BASED INDICATORS

FIELD OF THE INVENTION

This disclosure relates generally to the field of cabinetry and machine housing, and in particular to shaped cabinetry for indicating the function of components of a machine.

BACKGROUND OF THE INVENTION

Machines in the prior art such as copiers have cabinetry and housings which are generally flat, such as flat access panels and flat top, front, and side surfaces. Flat panels and surfaces are economical to manufacture, and may be formed with the components of the machine to constitute a relatively compact configuration.

However, flat panels give no immediate indication of the functions of the trays and panels. Paper tray access panels are typically indistinguishable from regions presenting information for visual output to the user. That is, input regions and output regions are not differentiated by shape, as all of such regions are generally flat. Accordingly, labels with indicia thereon are typically required to be provided and affixed to the appropriate panels to indicate the function of each panel, which thus increases the assembly time and cost of the machine. In addition, users and service personnel must learn the use of the panels by instructions and/or by experience. Such learning reduces the efficiency of the users and service personnel in having to learn and memorize the functions of each access panel as needed.

Accordingly, a need exists for cabinetry and housings of machines which provides quick visual indications of the functions of access panels.

SUMMARY OF THE INVENTION

It is recognized herein that differentiation in the shape of input regions and output regions of the cabinetry or housing of a machine such as a copier improves the use of the machine by users and service personnel.

A copier is disclosed having a plurality of paper trays for holding paper, and a housing having a front surface as cabinetry with shape-based indicators. The front surface includes a plurality of access panels adjacent to the paper trays, with each access panel allowing access to a respective paper tray, and each access panel has a curved exposed surface extending from the front surface. Each access panel includes a flat exposed surface extending from the respective access panel and having output indicators for indicating status conditions of a set of copying components.

Such disclosed cabinetry with shape-based indicators is more efficient to use by providing quick visual reference and differentiation of the function of the access panels and regions outputting information.

BRIEF DESCRIPTION OF THE DRAWINGS

The features of the present invention will become readily apparent and are to be understood by referring to the following detailed description of the preferred embodiments of the present invention, taken in conjunction with the accompanying drawings, in which.

DETAILED DESCRIPTION OF THE INVENTION

Figure 1:
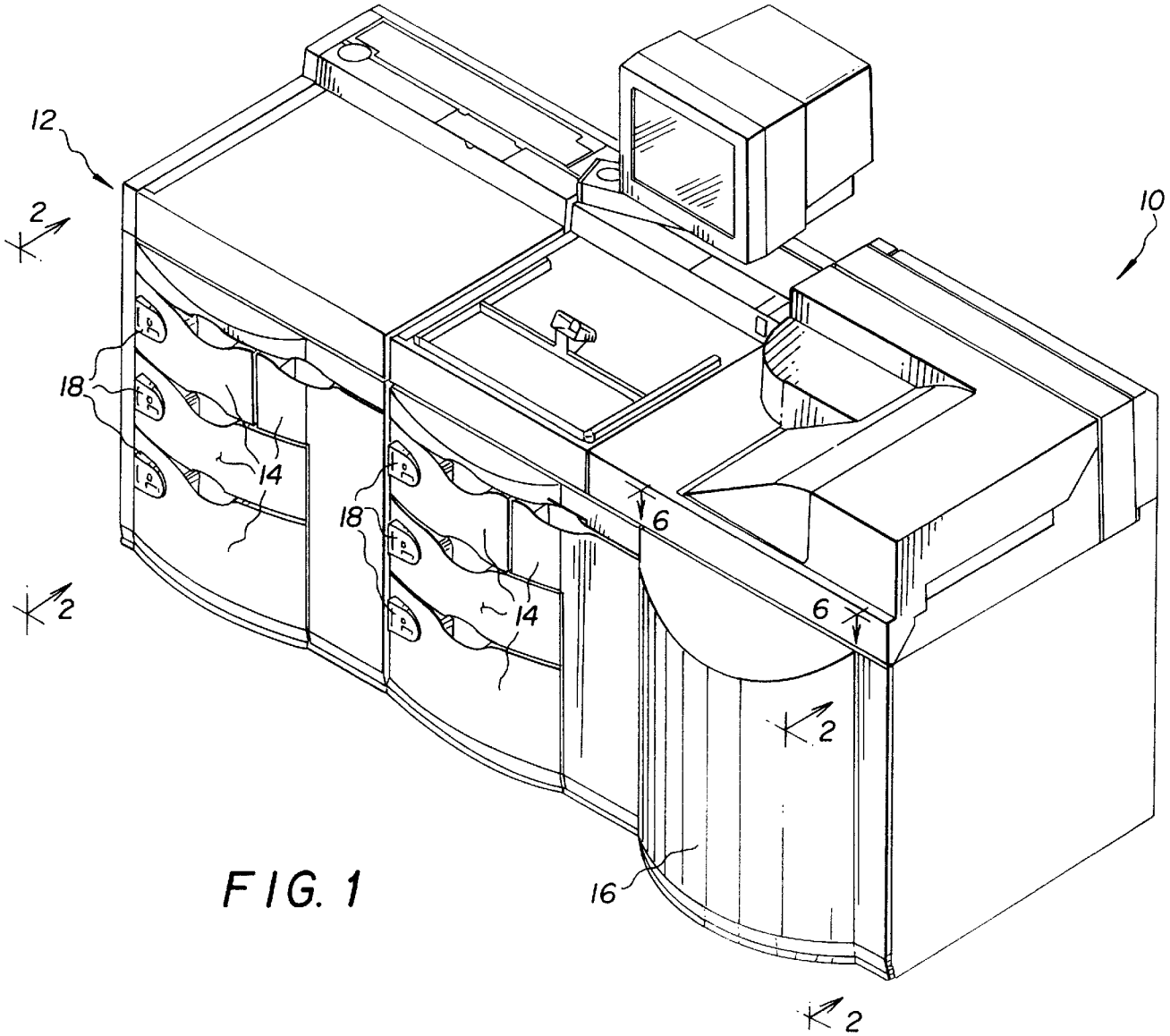
FIG. 1 is a top side perspective view of a copier.

Referring in specific detail to the drawings, with common reference numbers identifying similar or identical elements, steps, and features, as shown in FIG. 1, the present disclosure describes cabinetry with shape-based indicators for use in machines, such as a copier 10. The cabinetry forming the housing of the copier 10 includes a front surface 12 with a plurality of individual surfaces of access panels, doors, drawers, trays covers, etc. In a preferred embodiment, the front surface 12 of the disclosed cabinetry includes a plurality of access panels 14, 16 which have a curved and/or radiussed shape, and includes a plurality of substantially flat output regions 18; that is, the output regions 18 have exposed surfaces which are flat.

For example, the access panels 14 may be the exposed surfaces of paper trays and drawers which hold the paper supply of the copier 10. The access panel 16 may be the exposed surface of a door which, when opened, provides access to the innards of the copier 10. For example, when opened, the access panel 16 may expose a toner port, allowing a service person or a user to refill the toner of the copier 10. Accordingly, the access panels 14, 16 are areas for inputting material, such as paper and toner. The curved and/or radiussed surface of the access panels 14, 16 indicate the function of the access panels 14, 16; that is, the curved and/or radiussed surfaces indicate regions for inputting material, such as paper or toner.

Figure 2:
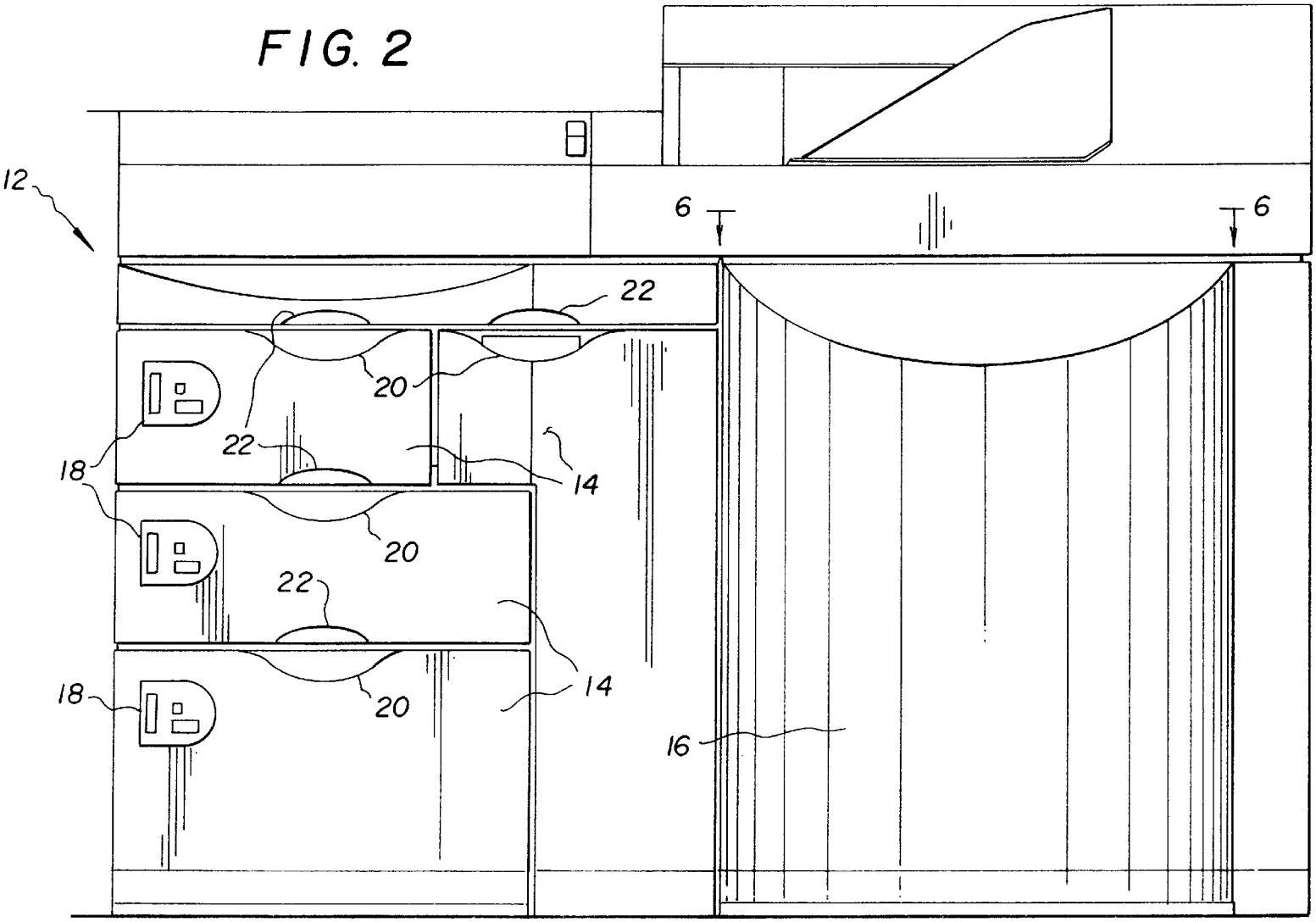
FIG. 2 is a front plan view of the front surface of the copier of FIG. 1 along lines 2—2.

As shown in FIG. 2, the access panels 14 also include curved handles 20 which may be grasped by the user to open the access panels 14. Curved recesses 22 positioned above corresponding curved handles 20 allow the user to insert a hand to more easily grasp the curved handles 20. Accordingly, the curved shapes of the handles 20 and recesses 22 also function as indicators, indicating regions for inputting items, such as the hands of the user. With such handles 20 and recesses 22 presented off surface, the curvature thereof visually indicates areas for operator access and input for improved and efficient use of the copier 10. In addition, the off surface handle access areas eliminate pinch points present on flat surfaces; that is, areas associated with prior art access panels which pinch or crush the hand or fingers of the user attempting to use the access panel. Accordingly, without such pinch points, the access and service of the copier 10 by the user is greatly improved.

The output regions 18 have flat or substantially flat surfaces, which function to indicate that such output regions 18 output information and/or material. The output regions 18 may be substantially flat within predetermined manufacturing tolerances, and are substantially flat or planar relative to the curved access panels 14, 16. Hereinafter, the term "flat" is understood to include such substantially flat surfaces.

Figure 3:
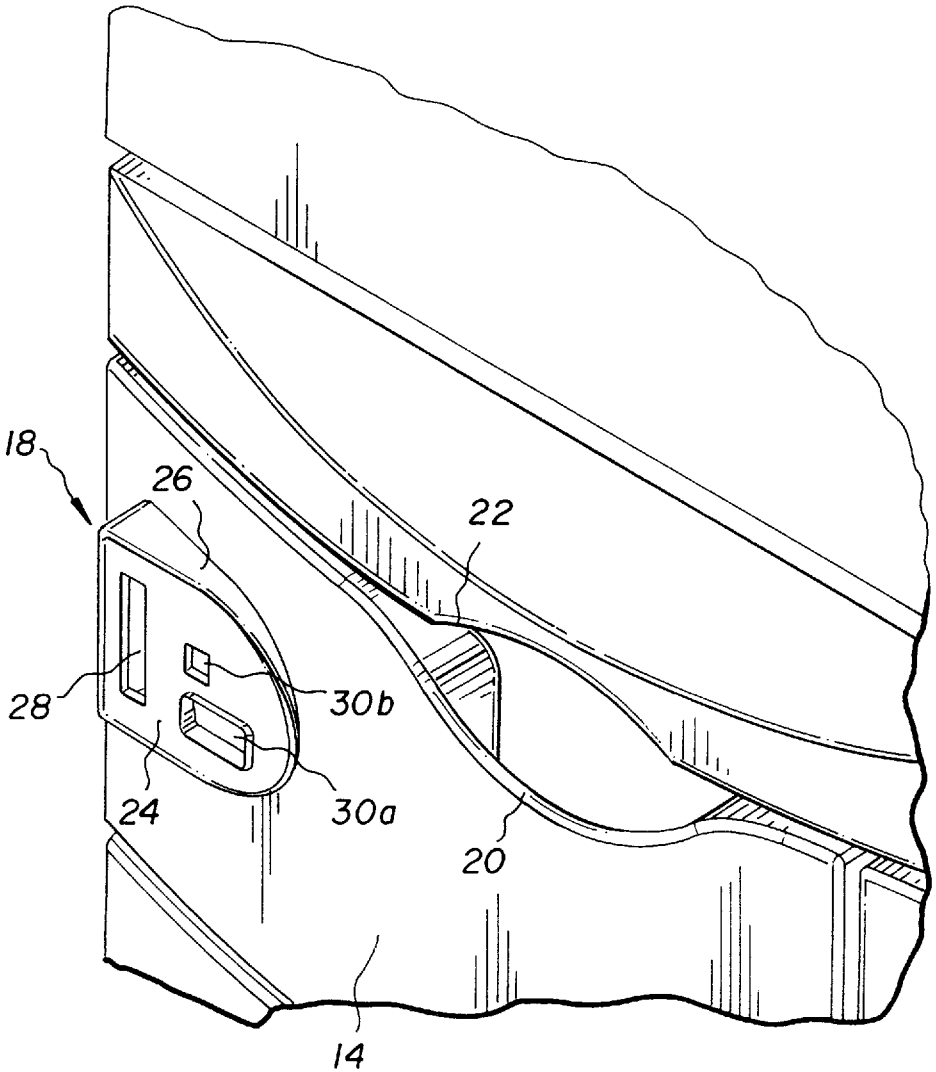
FIG. 3 is an enlarged top side perspective view of a portion of the front surface of the copier in FIG. 1 having a flat output region.
Figure 5:
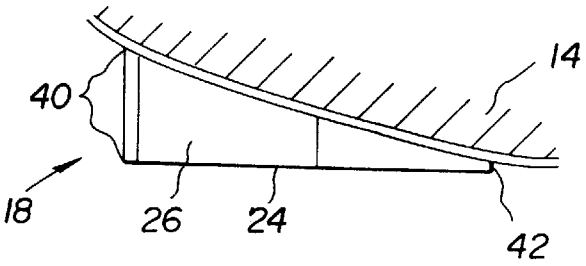
FIG. 5 is a top plan view of the flat output regions of FIGS. 3–4.
Figure 4:
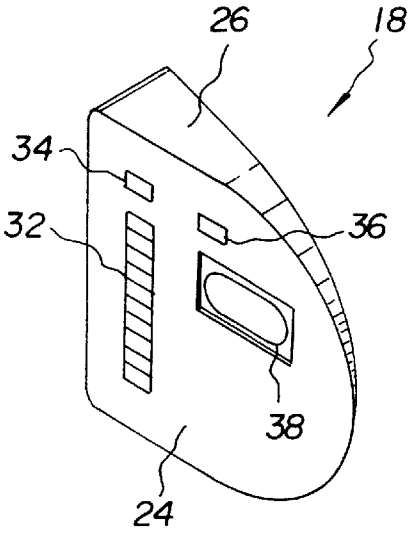
FIG. 4 is an alternative embodiment of the flat output region of FIG. 3.

As shown in FIG. 3, the output regions 18 have a flat frontal surface or face 24 and a flat peripheral surface 26 extending around the face 24 for connecting the face 24 to the curved surface of the access panel 14. As shown in FIGS. 3–5, the flat peripheral surface 26 does not have a uniform width, such that the flat face 24 is positioned parallel to other flat surfaces on the front surface 12 of the copier 10. Such flat faces 24 and the front surface 12 may in turn be perpendicular to a flat top surface of the copier 10.

In the embodiment shown in FIG. 3, the flat face 24 includes a paper window 28 and apertures 30*a*, 30*b* for outputting information to the user. For example, the paper window 28 exposes the amount of paper in the tray associated with a respective access panel 14, to indicate the level of paper and the need for refilling the paper therein. The apertures 30*a*, 30*b* may have predetermined functions. One of the apertures 30*a* may allow a label with indicia thereupon to be inserted and/or mounted therein, for example, a label indicating the type and/or size of paper loaded in the tray associated with the respective access panel 14. The aperture 30*a* may also accommodate lights, such as light bulbs, light emitting diodes (LEDs), and liquid crystal displays (LCDs), for outputting light, for example, to indicate an empty tray condition. The aperture 30*b* may accommodate an unlock button to enable ready access to a respective paper supply internal to the copier 10. Thus, the flat output regions 18 and flat surfaces thereof, in conjunction with lights and/or labels, output information to the user, with the flatness of the flat output regions 18 and flat surfaces thereof functioning to indicate that information is being output therefrom.

In an alternative embodiment shown in FIG. 4, the flat output regions 18 may include an illuminated paper level indicator 32 in the flat face 24, which may include LCDs, LEDs, or bulbs in, for example, a linear or bar configuration. Alternatively, the LCDs and/or LEDs may have a segmented pie configuration or other known configurations, with or without indicia upon or adjacent thereto, for outputting the level of paper in the associated tray of the respective access panel 14.

The flat output region 18 of FIG. 4 may also include other indicator lights 34, 36 in the flat face 24, such as bulbs, LCDs and/or LEDs; for example, the indicator light 34 may be adjacent to the paper level indicator 32 and may have a green color which, when lit, indicates that the associated paper tray is full. The indicator light 36 may have a red color which, when lit, indicates that the associated paper tray is empty.

The flat output region 18 may also include a flat indicator region 38 in the flat face 23 which may include a label with indicia thereon, a back-lit illuminated label, or an LCD which displays a message, such as the paper type and/or size, or an unlock button. With such paper supply indicators presented off surface of the main housing, better visibility is provided to the operator to determine the status of each paper supply for improved and efficient use of the copier 10.

As shown in FIG. 5, the flat peripheral surface 26 does not have a uniform width; that is, a first width 40 is greater than a second width 42 to supplement the curvature of the curved access panel 14. In a preferred embodiment, the flat faces 24 of each of the output regions are parallel to each other. In an alternative embodiment, the flat faces 24 may extend to a common distance from the front surface 12 of the copier 10, so as to be parallel and aligned on a common planar surface in space.

It is understood that the access panels 14, 16 may have a common curvature but have different widths, or alternatively may have different curvatures.

Figure 6:
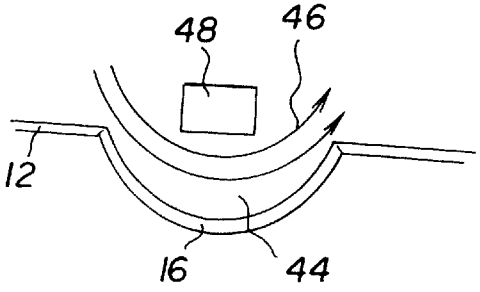
FIG. 6 is a top cross-sectional schematic view of a portion of the copier of FIG. 1 along lines 6—6.

In addition, the curved access panel 14, 16 may have other functions in addition to indicating that such access panels 14, 16 are for inputting material. For example, as shown in FIG. 6, the access panel 16 for accessing a toner input port may be configured and dimensioned to have a curved interior surface forming an open area 44 of the interior of the copier 10 behind the front surface 12 when the access panel 16 is closed. The open area 44 may permit more internal air flow for circulating air currents 46 within the copier 10 to cool components 48, for example, disposed within the copier 10. Such improved air flow is compatible with and/or complementary to an environmental control system which may be used in or with the copier 10.

With curved or radiussed areas to designate input areas, and non-radiussed or flat areas to designate output areas, the front surface 12 of the copier 10 provides quick visual reference to the user for receiving information on the functions of the copier 10 and for accessing the components therein.

Such curved input and access regions combined with flat output regions also provide a pleasing user-friendly appearance which complements the functional aspects.

While the disclosed cabinetry using shape-based indicators is particularly shown and described herein with reference to the preferred embodiments, it is to be understood that various modifications in form and detail may be made without departing from the scope and spirit of the present invention. Accordingly, modifications such as any examples suggested herein, but not limited thereto, are to be considered within the scope of the present invention.

The invention has been described in detail with particular reference to certain preferred embodiments thereof, but it will be understood that variations and modifications can be effected within the spirit and scope of the invention.

PARTS LIST

10 copier
12 front surface
14 curved paper and component access panel
16 curved toner access panel
18 flat output region
20 curved handles
22 curved recess
24 flat face of output region
26 flat peripheral surface of output region
28 paper window
30 apertures
32 paper level indicator
34 indicator light
36 indicator light
38 indicator region
40 first width
42 second width
44 open area
46 air currents
48 component

What is claimed is:

1. A housing for a machine comprising:

an input region, having a curved exposed surface for accessing components of the machine for input of material therein, including a curved access panel having a curved handle for grasping and opening the curved access panel, and including a curved recess adjacent to the curved handle to facilitate the grasping of the curved access panel; and an output region, having a substantially flat exposed surface with an output device disposed therein to output information pertaining to the machine.

2. The housing of claim 1 wherein the curved exposed surface of the input region is curved on an interior surface to provide an area for air circulation about a component of the machine.

3. The housing of claim 1 wherein the substantially flat exposed surface of the output region includes an aperture for conveying information.

4. The housing of claim 3 wherein the aperture provides a window to an interior section of the machine to indicate material disposed in the interior section.

5. The housing of claim 3 wherein the aperture mounts a label with indicia thereupon.

6. The housing of claim 3 wherein the aperture has an indictor light mounted therein to indicate a status condition of the machine.

7. The housing of claim 6 wherein the aperture has a plurality of indicator lights forming a status bar for indicating a level corresponding to material disposed in an interior section of the machine.

8. A copier comprising:

a plurality of paper trays for holding paper;

a plurality of access panels, each access panel for allowing access to a respective paper tray, wherein each access panel has a curved exposed surface and has a curved handle for gasping and opening the access panel, and each access panel includes a curved recess adjacent to the curved handle to facilitate the grasping of the access panel; and a plurality of flat exposed surfaces, each flat exposed surface having output indicators for indicating status conditions of a set of copying components.

9. The copier of claim 8 wherein each access panel includes a respective one of the flat exposed surfaces having a paper level indicator as the output indicator.

10. The copier of claim 8 further comprising:

a toner port access panel for accessing a port for inputting toner, wherein the toner port access panel is curved.

11. The copier of claim 10 wherein the toner port access panel has a curved interior surface to provide an area for air circulation about at least one of the copying components.

12. The copier of claim 9 wherein each flat exposed surfaces includes an aperture as the paper level indicator, the aperture being a window for viewing paper in the respective paper tray.

13. The copier of claim 9 wherein the flat exposed surfaces include a plurality of apertures.

14. The copier of claim 13 wherein at least one aperture of said plurality of apertures has an indicator light mounted therein to indicate a status condition of the copier.

15. The copier of claim 13 wherein at least one aperture of said plurality of apertures has a plurality of indicator lights forming a status bar for indicating paper disposed in a respective paper tray.

* * * * *